United States Patent [19]

Mashimo et al.

[11] 4,084,871

[45] Apr. 18, 1978

[54] METHOD FOR MANUFACTURE OF LAMP BULBS

[75] Inventors: Michiya Mashimo; Hidehiro Shinada, both of Yokohama, Japan

[73] Assignee: Tokyo Shibaura Electric Co., Ltd., Kawasaki, Japan

[21] Appl. No.: 750,629

[22] Filed: Dec. 15, 1976

[30] Foreign Application Priority Data

Dec. 18, 1975 Japan ..... 50-150975

[51] Int. Cl.[2] ..... H01J 9/02

[52] U.S. Cl. ..... 316/19; 29/25.16

[58] Field of Search ..... 29/25.14, 25.15, 25.16; 316/19

[56] References Cited

U.S. PATENT DOCUMENTS

| | | | |
|---|---|---|---|
| 3,441,774 | 4/1969 | Stone et al. | 313/174 |
| 3,736,455 | 5/1973 | Noltelteirs et al. | 313/274 |

*Primary Examiner*—Richard B. Lazarus

*Attorney, Agent, or Firm*—Cushman, Darby & Cushman

[57] ABSTRACT

A method for manufacture of lamp bulbs wherein four wires are arranged in parallel with and spaced apart by a suitable distance from each other and supported by a plurality of glass beads which are melted when the wires are attached. Two inner wires of the four wires are cut off at predetermined points and bent at cutout ends whereby lead and anchor wires are provided whereas the two outer wires are bent to form frame wires, whereby a filament-supporting assembly is provided; thereafter filaments are supported between the lead wires of the filament supporting assembly and engaged with the anchor wire; the filament-supporting assembly with the filaments supported thereon is placed into a glass envelope; the envelope is evacuated and sealed; and a base is attached to the envelope.

9 Claims, 7 Drawing Figures

METHOD FOR MANUFACTURE OF LAMP BULBS

The present invention relates to a method for manufacture of lamp bulbs having a plurality of light emitting elements.

There have been proposed and devised various types of tubular lamp bulbs with an inner diameter less than 16 mm because of their long service life and high efficiency. Within a tubular lamp bulb with an inner diameter less than 16 mm, the convection of gas within an envelope is suppressed so that the temperature drop of filaments may be prevented. As a result, the efficiency may be improved and the tubular lamp may be installed in any direction and even in vertical position. The inventors have already devised elongated interior tubular lamp bulbs 220 to 1,500 mm in length in which a plurality of filaments are supported and spaced apart in the axial direction of an envelope so that it is excellent both in lighting characteristics and design. As compared with the conventional lamp bulb, the construction of the interior tubular lamp bulb is very complicated so that the manufacturing cost is increased. This problem cannot be overcome by a method for manufacturing lamp bulbs having a plurality of filaments by especially welding a plurality of filaments to lead wires of a conventional lamp bulb having one filament. Thus manufactured lamp bulbs have a complicated outer appearance especially when the lamp is turned off. Therefore, these lamp bulbs are also unsatisfactory from the aesthetical standpoint.

One of the objects of the present invention is therefore to provide a novel method for manufacture of lamp bulbs having a plurality of filaments.

Another object of the present invention is to provide a method for manufacture of lamp bulbs wherein a welding step is very simple so that the mass production may be feasible, resulting in considerable reduction in cost.

A further object of the present invention is to provide a method for manufacture of lamp bulbs wherein lamp bulbs having a different number of filaments may be manufactured through substantially similar steps.

A still further object of the present invention is to provide a method for manufacture of lamp bulbs wherein lamp bulbs with filaments arranged and electrically connected in various manners may be manufactured through substantially similar steps.

The present invention provides a method for manufacture of lamp bulbs comprising: a step for providing a filament-supporting assembly, including a first step for providing a wire assembly wherein more than three wires are extended straightly in parallel with each other, spaced apart from each other by a suitable distance and supported by a plurality of isolators which are made of an electrically insulating material and are spaced apart from each other by a suitable distance, a second step for providing a plurality of lead wire pieces each extended into a predetermined space defined by the adjacent isolators and spaced apart from each of the other by a predetermined distance, each lead wire pieces being provided by cutting off a predetermined length of at least one of said wires except the outermost ones in said predetermined space, and a third step for electrically connecting said lead wire pieces to the outermost wires, whereby a filament-supporting assembly is provided, and a step for supporting a plurality of filaments each between each of said plurality of lead wire pieces on said filament-supporting assembly; and a step for placing said filament-supporting assembly with said plurality of filaments supported thereon into a glass envelope and thereafter evacuating said glass envelope and sealing it.

This invention can be more fully understood from the following detailed description when taken in conjunction with the accompanying drawings, in which.

Prior to the description of a method in accordance with the present invention for manufacture of lamp bulbs, the construction of a lamp manufactured by this method will be described with reference to FIG. 1.

Figure 1:
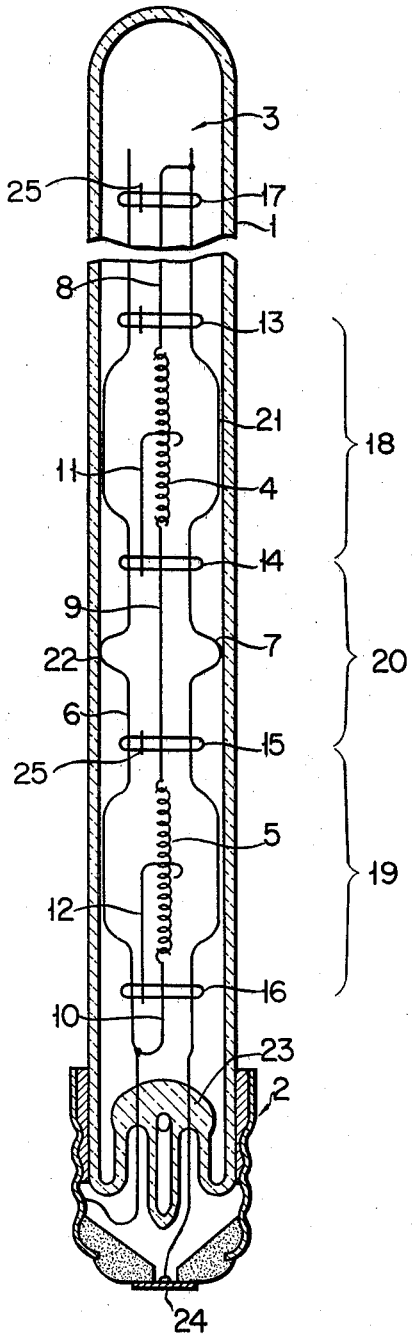
FIG. 1 is a schematic sectional view of a lamp bulb manufactured by one preferred embodiment of a method for manufacture of lamp bulbs in accordance with the present invention.

A tubular glass envelope 1 of the lamp bulb shown in FIG. 1 is molded from soft glass such as soda lime glass, semi-hard glass such as borosilicate glass or aluminosilicate glass, has an inner diameter of less than 16 mm or preferably 12.5 mm and is filled with an inert gas such as argon, nitrogen, krypton or the like or a mixture thereof and halogen if required. A screw type base 2 is fitted over one end or base of the glass envelope 1. Enclosed within the glass envelope 1 is a filaments-supporting assembly 3 which constitutes one of the major elements of the lamp bulb having a plurality of light emitting elements. The filaments-supporting assembly 3 functions as an internal lead wire for supplying current to filaments 4 and 5 connected in series, and comprises frame wires 6 and 7 which bring the whole structure of the supporting assembly 3 into contact with the inner wall surface of the glass envelope 1 so as to securely hold it in position, lead wires 8, 9 and 10 being electrically interconnected through the filaments 4 and 5 for suspending and supporting them and also functioning as feeders. Anchor wires 11 and 12 support the filaments 4 and 5 at a point intermediate at their ends, and insulators such as glass beads 13, 14, 15, 16 and 17 integrally hold the anchor wires 11 and 12, the frame wires 6 and 7, the lead wires 8, 9 and 10 and the anchor wires 11 and 12. In the embodiment shown, only two filaments are shown, but it is apparent that more than two filaments may be provided and that depending upon the number of filaments, the number of the lead wires, anchor wires and glass beads of the filaments supporting assembly 3 may be varied. Used as said frame wires 6 and 7 and lead wires 8, 9 and 10 are nickel wires or nickel plated iron wires, and molybdenum or tungsten wires are used as the anchor wires. The glass beads 13, 14, 15, 16 and 17 are spaced apart by a predetermined distance, and are members for electrically isolating the frame wires 6 and 7, lead wires 8, 9 and 10 and anchor wires 11 and 12 which are extended in parallel with each other in the same plane.

The filaments-supporting assembly 3 consists of filament supporting sections 18 and 19 at which the filaments are supported and a filaments non-supporting section 20, these sections being alternately located. In the filaments supporting sections 18 and 19 of the assembly 3, the frame wires 6 and 7 are bent outwardly to form expanded sections 21 which are in opposed relation with the filament 4 and 5. In the filaments non-supporting section 20 of the assembly 3 the center portions of the frame wires 6 and 7 are bent to form projected sections 22. The expanded sections 21 of the filaments supporting sections 18 and 19 and the projected sections 22 of the filaments non-supporting section 20 are made into resilient contact with the inner wall of the glass envelope 1, and the whole of the filaments-supporting assembly 3 of the supporting sections 18, 19 and 20 is held by the reaction forces of the expanded sections 21 and projected section 22.

The lead wires 8, 9 and 10 are mounted substantially at the center of the glass beads 13 to 17 so as to be placed along the axis of the glass envelope 1, and have their one ends located in the filaments-supporting sections 18 and 19, respectively. Between the lead wires 8, 9 and 10 are extended the filaments 4 and 5 so as to be electrically connected to each other. The anchor wires 11 and 12 have one end securely fixed to the glass beads 11 and 12, respectively and have their other end extended to midpoints at ends of the filaments supporting sections 11 and 12, respectively, and bent substantially at right angles and wound around the filaments 4 and 5, respectively, thereby suspending them. The frame wire 6 and 7 are extended from the inside of the glass envelope 1 through a seal 23 thereof outwardly beyond the glass envelope, and the frame wire 6 is connected electrically to a main body of the base whereas the flame wire 7, to an eyelet terminal 24 of the base 2. Remaining wires 25 attached to the glass beads 13, 14, 15, 16 and 17, respectively, are wires produced when the anchor wires 11 and 12 are provided in the method for manufacture of lamp bulbs in accordance with the present invention to be described below.

The lamp bulb with the above construction is manufactured through steps to be described below. One embodiment of the method for manufacture of lamp bulbs in accordance with the present invention will be described with reference to FIGS. 2. through 6.

Figure 2:
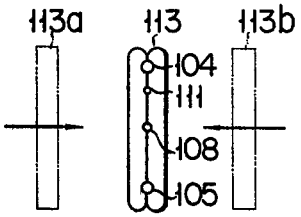
FIGS. 2 through 6 are schematic views used for the explanation of steps of the method of the present invention.

Firstly, a plurality of wires are arrayed in parallel with each other and spaced apart from each other by a suitable distance. In the embodiment shown, first, second, third and fourth or four wires 104, 105, 108 and 111 of a predetermined length are shown. The diameters of these wires are different depending upon the purposes for use, and are determined. The first and second wires 104 and 105 are turned into the frame wires 6 and 7; the third wire 108, the lead wires 8, 9 and 10 and the fourth wire 111, the anchor wires 11 and 12. The four, parallel-arrayed wires 104, 105, 108 and 111 are interposed at several places between a pair of glass members 113*a* and 113*b* parts of which are heated and softened, as shown in FIG. 2, and are embedded into a glass rod 113 or glass bead 13 produced in this step. When a plurality of glass rods 113 are cooled and hardened, said a plurality of wires 104, 105, 108 and 111 are integrally attached to the glass rods 113 or glass beads 13, 14, 16 and 17, respectively. Since the first and second wires attached to the glass beads 13 and 14 are bent to be formed into the frame wires 4 and 5 of the filaments-supporting assembly 3 so that its spacing is reduced, the spacing between the glass beads 13, 14, 16 and 17 is previously selected to compensate this reduction. Especially the spacing between the glass beads 13 and 14 and between the glass beads 15 and 16 which correspond to the filament supporting sections 18 and 19, respectively of the filament-supporting assembly 3 is selected longer than the spacing between the glass beads 14 and 15 corresponding to the filaments non-supporting section of the filaments-supporting assembly 3.

Figure 4:
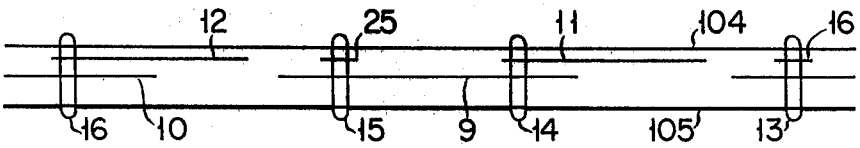
Figure 5:
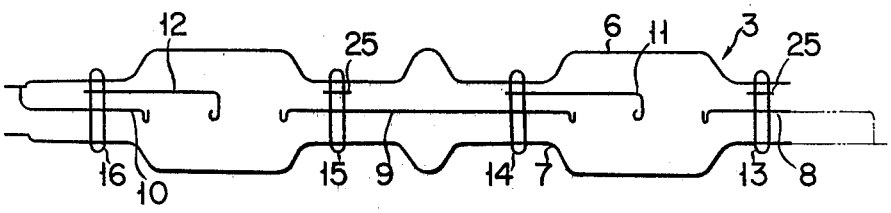

Next the third and fourth wires 108 and 111 which are located at the center of the four wires attached to the glass beads 13, 14, 16 and 17 are cut at their respective positions as shown in FIG. 4 to remove unused parts. That is, the third wire 108 is cut off so that sections which occupy center portions between the glass beads 15 and 16 and between the glass beads 13 and 14 are removed, whereas the fourth wires 111 are cut off so that portions except a portion extending from the glass bead 16 to the glass bead 15 and a portion extending from the glass bead 14 to the glass bead 13 is removed. As a result, in the example shown, the third wires 108 are divided into three, whereas the fourth wires 111, into two. Furthermore, the remaining wires 25 results. Leading ends of the third wires 108 which are divided into three and which are located between the glass beads 13 and 14 and between the glass beads 15 and 16 are arcuately bent for suitably supporting the filaments 4 and 5 as shown in FIG. 5, whereby the lead wire pieces 8, 9 and 10 are provided. Leading ends of the fourth wires 111 which are divided into two and which are located between the beads 13 and 14 and between the glass beads 15 and 16 are bent substantially at right angles and curved articuately for supporting the filaments 4 and 5, whereby the anchor wire pieces 11 and 12 are provided.

Of the four wires 104, 105, 108 and 111, the first and second wires 104 and 105 which are located outwardly, are bent into a predetermined shape to provide the frame wires 6 and 7 so that filaments-supporting assembly 3 is provided. Between the glass beads 13 and 14 and between the glass beads 15 and 16, both end portions of the first and second wires 104 and 105 are bent and are expanded outward. The center portions of the first and second wires 104 and 105 between the glass beads 14 and 15 are projected outwardly. Therefore, the filaments-supporting assembly 3 is provided with expanded sections 21 and the projected section 22. After the expanded sections 21 and the projected section 22 having been formed, the lead wire pieces 8 and 10 are electrically and mechanically connected to the frame wires 6 and 7 with solder or the like.

Finally, the filaments 4 and 5 are placed in the filaments supporting assembly 3, the filaments supporting assembly 3 having pieces 11 and 12 is placed into the glass envelope 1, and then the base 2 or the like is attached to the glass envelope 1, whereby the lamp tube is completed. Pieces 11 and 12 are supported between the arcuate leading ends of the lead wire pieces 8, 9 and 10 and are electrically and mechanically joined to the lead wires 8, 9 and 10 by soldering or the like, and the arcuate ends of the anchor wire pieces 11 and 12 are engaged with the center portions of the filaments, whereby they are suspended. Thereafter, the filaments-supporting assembly 3 is placed into the glass envelope. The steps following the above-mentioned steps are carried out in the manner well known in the art so that the lamp bulb as shown in FIG. 1 is provided. That is, the lamp bulb is completed through a step for evacuating the glass envelope 1, a step for filling an inert gas or the like if so required, a step for sealing the glass envelope 1 and a step for attaching a base.

Figure 3:
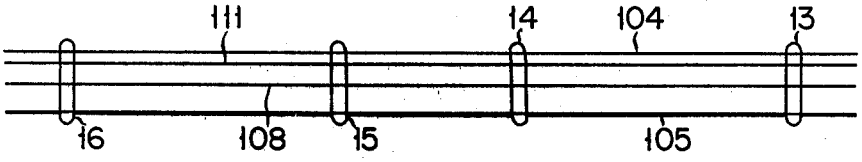
Figure 6:
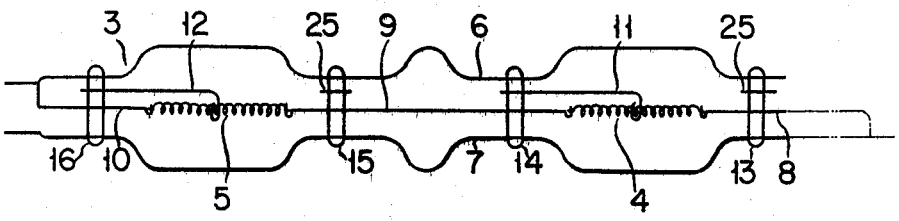
Figure 7:
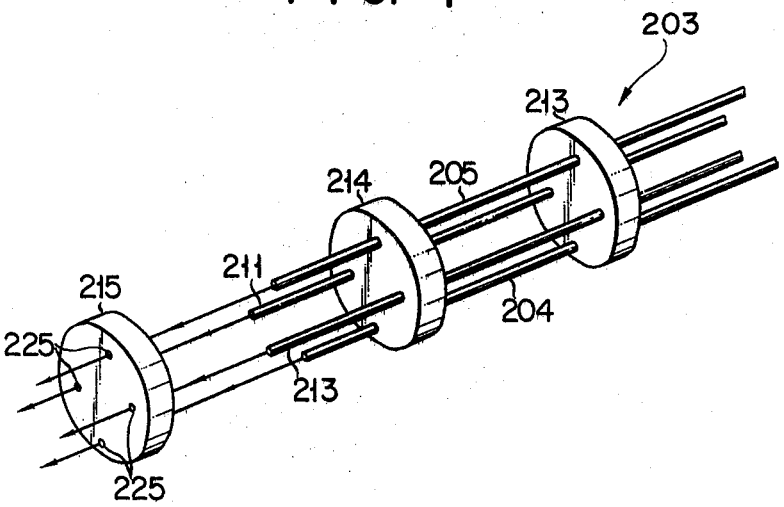
FIG. 7 is a perspective view of another embodiment of the present invention corresponding to the step shown in FIG. 3.

In FIG. 7 there is shown a filaments-supporting assembly 203 used in a modification which is different from the above described embodiment of the method for manufacture of lamp bulbs in accordance with the present invention. FIG. 7 shows a step corresponding to FIGS. 2 and 3 used for the explanation of the above described embodiment. Another feature of the embodiment shown in FIG. 7 is that disk-shaped glass materials 213, 214 and 215 are used instead of the glass beads in a rod shape shown in FIGS. 2 through 6. Since the number of wires held by these glass beads 13 through 16 is limited, instead of them, the disk-shaped glass materials 213, 214 and 215 are used to hold a plurality of wires 204, 205, 211 and 213 three-dimensionally. As in the embodiment shown in FIGS. 2 through 6, only four wires 204, 205, 211 and 213 are shown, but more than four wires may be easily supported three-dimensionally because the glass materials 213, 214 and 215 are in the form of a disk. Similarly in FIG. 3 only four wires 104, 105, 108 and 111 are shown as being supported, but the number of wires supported by the glass beads is not limited to four, but may be a predetermined number more than four but less than the number of wires supported by said glass materials 213, 214 and 215. As described before, the four wires 104, 105, 108 and 111 or 204, 205, 208 and 211 are disposed so as to be formed into the frame wires 6, 7, the lead wire pieces 8, 9 and 10 and anchor wire pieces 11, but when more than four wires are used, the remaining or a plurality of wires are formed into, for instance, lead wires pieces so that a mode of connection of a plurality of filaments may be changed. More specifically, in the example shown, the filaments are connected in series through the lead wire pieces 8, 9 and 10 which are formed by cutting the wire 108 and bending it, but another wire (not shown) may be used to form a plurality of lead wire pieces so that filaments may be supported between them and a plurality of filaments may be connected in parallel. As described above, it is preferable to use the disk-shaped glass materials 213, 214 and 215 for supporting a plurality of wires, but these glass materials 213, 214 and 215 are not limited to a disk shape, but may be plate materials in the form of a square or the like.

In FIG. 7, the disk-shaped glass materials 213, 214 and 215 are formed with through holes 225 for inserting wires, and said a plurality of wires 204, 205, 208 and 211 are inserted through the through holes 225 and extended only through the glass materials 213, 214 and 215. Therefore even when said glass materials 213, 214 and 215 are held by external jigs, said wires 204, 205, 211 and 213 may be freely displaced.

The filaments-supporting assembly 203 with the above construction is constructed three-dimensionally substantially as shown in FIG. 5 as the wires 204 and 205 are bent as shown in FIG. 5. Thereafter said glass materials 213, 214 and 215 are heated and softened. While the wires 204, 205, 211 and 213 are held in position, the portions required of the wires 211 and 213 are cut off and parts of them are bent.

As with the embodiment shown in FIG. 7, in the embodiment shown in FIGS. 2 through 6, the glass beads 13, 14, 15 and 16 may be previously formed with through holes for inserting wires, and the wires 104, 105, 108 and 111 may be supported by these through holes. When steps following this step are similar to those of the embodiment shown in FIG. 7, the filaments supporting assembly as shown in FIG. 6 may be formed.

In the above-described embodiments, only the examples for providing one filaments-supporting assembly 3 or 203 have been described, but it is easy to manufacture filaments-supporting assemblies 3 and 203 continuously by the use of means for continuously supplying wires. In addition, it is possible to manufacture a plurality of filaments-supporting assemblies 3 and 203 at the same time. In either of the embodiments described above, the frame wires 6 and 7 of the filaments-supporting assembly 3 or 203 are brought into contact with the inner wall of the glass envelope 1 to hold the assembly, but instead of bringing the frame wires into contact with the inner wall of the glass envelope 1, other members such as glass materials 213, 214 and 215 shown in FIG. 7 may be brought into contact with the inner wall of the glass envelope 1 for supporting the filament-supporting assembly 203.

When the filament has sufficient strength so as not to be extended or broken by its own weight or by vibration after it has been extended between the lead wires or the length of the filament is so short that it is not influenced by its own weight or by vibration, the anchor wires 11 and 12 are not especially required for the lamp bulbs. Therefore in the steps for manufacturing the lamp bulbs of the type described above, the wires 111 or 211 which are formed into the anchor wire pieces 11 and 12 are not necessary.

According to the above described methods for manufacture of lamp bulbs of the present invention, the lamp bulbs having a plurality of filaments may be easily manufactured through exceedingly simple steps so that the above methods for manufacture for lamp bulbs are adapted for automation and mass-production and consequently a cost of lamp bulbs may be reduced. According to the method for manufacture of lamp bulbs of the present invention, the filament-supporting assembly is so formed as to support a plurality of filaments by using a plurality of parallel wires so that welding spots may be considerably reduced. Since the welding spots are less, the filament-supporting assembly has greater strength and the manufacture of filament supporting assembly themselves is easy. Since the wires are previously supported by the glass materials, there is no fear at all that they are so crossed as to make operation complicated, whereby the manufacture of lamp bulbs may be efficiently carried out simultaneously.

According to the method for manufacture for lamp bulbs of the present invention, lamp bulbs in which the number of filaments are changed may be easily manufactured through the steps substantially similar to those described above. More specifically, depending upon the number of filaments, a filament supporting assembly may be manufactured through substantially similar steps only by changing the length of frame wires, the length of lead wires and the number of glass beads. Only with the use of glass envelops suitable for enclosing therein the filament-supporting assembly, lamp bulbs having an arbitrary number of the filaments may be manufactured, and a lamp bulb manufacturing apparatus (not shown) may be used in common.

According to the method for manufacture for lamp bulbs of the present invention, lamp bulbs in which an electrical connection relationship between a plurality of filaments is changed may be manufactured through substantially similar steps by changing the number of wires of the filament supporting assembly. More specifically, an electrical series or parallel connection among a plurality of filaments may be easily accomplished by changing the lengths and positional relationship of a plurality wires.

We claim:

1. A method for manufacture of lamp bulbs comprising:

(a) steps providing a filament-supporting assembly, including:

(i) a first step of providing a wire assembly wherein more than three wires are extended in a straight line in parallel with each other, spaced apart from each other by a suitable distance and supported by a plurality of isolators which are made of an electrically insulating material and are spaced apart from each other by a suitable distance, (ii) a second step of providing a plurality of lead wire pieces each extended into a predetermined space defined by the adjacent isolators and spaced apart from each other by a predetermined distance, each lead wire pieces being provided by cutting off a predetermined length of at least one of said wires except for at least two of the outermost ones in said predetermined space, and (iii) a third step of electrically connecting said lead wire pieces to the outermost wires, whereby a filament-supporting assembly is provided, and (b) a step of supporting a plurality of filaments each between at least two of said plurality of lead wire pieces on said filament-supporting assembly; and (c) a step of placing said filament-supporting assembly with said plurality of filaments supported thereon into a glass envelope and thereafter evacuating said glass envelope and sealing it.

2. A method as set forth in claim 1, wherein said second step (ii) of providing a filament-supporting assembly further includes a step of providing frame wires, said frame wires being formed by bending said outermost wires in a manner that they are projected outwardly of said filament-supporting assembly.

3. A method as set forth in claim 1, wherein said steps of providing a filament-supporting assembly include:

(i) a first step of providing a wire assembly wherein more than four wires are extended in a straight line in parallel with each other, spaced apart from each other by a suitable distance and supported by a plurality of isolators which are made of an electrically insulating material and are spaced apart from each other by a suitable distance, (ii) a second step of providing a plurality of lead wire pieces and anchor wire pieces each extended into a predetermined space defined by the adjacent isolators and spaced apart from each other by a predetermined distance, each of the lead wire pieces and anchor wire pieces being provided by cutting off respective predetermined lengths of at least two of said wires except the outermost ones in said predetermined space and a respective one of said extended end portions of the anchor wire pieces being bent forward of the axial center of said wire assembly, and (iii) a third step of electrically connecting said lead wire pieces to the outermost wires whereby a filament-supporting assembly is provided.

4. A method as set forth in claim 3, wherein said step of supporting a plurality of filaments further includes a step of engaging each of said plurality of filaments with a corresponding one of said extended end portions of said anchor wire pieces.

5. A method as set forth in claim 1, wherein said second step (ii) of providing a filament-supporting assembly further includes a step of connecting in series said plurality of filaments to each other through said lead wire pieces.

6. A method as set forth in claim 1, wherein said step for supporting a plurality of filaments further includes a step for connecting in series said plurality of filaments to each other through said lead wire pieces.

7. A method as set forth in claim 1, wherein said steps of providing a filament-supporting assembly include:

(ii) A second step of providing a plurality of lead wire pieces each extended into a predetermined space defined by the adjacent isolators and spaced apart from each other by a predetermined distance, each lead wire pieces being provided by cutting off respective predetermined lengths of at least two of said wires except the outermost ones in said predetermined space, and (iii) a third step of electrically connecting said lead wire pieces to the outermost wires whereby a filament supporting assembly is provided;

said step of supporting a plurality of filaments further includes a step for connecting said plurality of filaments to said lead wire pieces in a manner that a plurality of resultant filament units are arranged in parallel to each other.

8. A method as set forth in claim 1, wherein in said first step (i) of providing a filament-supporting assembly, said insulating material is thermally fusible and is fused to said wires.

9. A method as set forth in claim 1, wherein in said first step (i) of providing a filament-supporting assembly, said insulating material is thermally fusible and is provided with a through hole for permitting insertion therethrough of said wires, said first step further including a step of inserting said wires into said through hole of said insulating material and supporting said inserted wires by said insulating material; and said second step (ii) of providing a filament-supporting assembly further includes a step of thermally fusing said insulating material having said wires thereby to secure said wires to said insulating material.

* * * * *